US007446737B2

(12) United States Patent
Maede et al.

(10) Patent No.: US 7,446,737 B2
(45) Date of Patent: Nov. 4, 2008

(54) ORGANIC EL PANEL DRIVING CIRCUIT, ORGANIC EL DISPLAY DEVICE AND ORGANIC EL PANEL DRIVING CIRCUIT INSPECTING DEVICE

(75) Inventors: Jun Maede, Kyoto (JP); Shinichi Abe, Kyoto (JP); Akio Fujikawa, Kyoto (JP); Masanori Fujisawa, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 107 days.

(21) Appl. No.: 10/593,781

(22) PCT Filed: Mar. 22, 2005

(86) PCT No.: PCT/JP2005/005123

§ 371 (c)(1),
(2), (4) Date: Sep. 22, 2006

(87) PCT Pub. No.: WO2005/091265

PCT Pub. Date: Sep. 29, 2005

(65) Prior Publication Data

US 2007/0152935 A1 Jul. 5, 2007

(30) Foreign Application Priority Data

Mar. 24, 2004 (JP) ..... 2004-087013

(51) Int. Cl.
*G09G 3/30* (2006.01)
*G09G 3/10* (2006.01)

(52) U.S. Cl. ..... 345/76; 315/169.2; 315/169.3

(58) Field of Classification Search ..... 315/169.2, 315/169.3; 345/204, 76, 77, 82, 83, 904; 324/403, 770, 537
See application file for complete search history.

(56) References Cited

U.S. PATENT DOCUMENTS

| | | | | |
|---|---|---|---|---|
| 5,444,390 | A * | 8/1995 | Bartlett et al. | 324/770 |
| 6,633,135 | B2 * | 10/2003 | Nara et al. | 315/169.3 |
| 6,762,735 | B2 * | 7/2004 | Koyama | 345/76 |
| 7,046,220 | B2 * | 5/2006 | Tagawa et al. | 345/76 |
| 7,106,283 | B2 * | 9/2006 | Satoh | 345/76 |

FOREIGN PATENT DOCUMENTS

| | | |
|---|---|---|
| JP | 2000-275610 | 10/2000 |
| JP | 2003-288051 | 10/2003 |
| JP | 2004-177514 | 6/2004 |
| JP | 2004-295081 | 10/2004 |
| JP | 2005-62836 | 3/2005 |

* cited by examiner

*Primary Examiner*—Thuy Vinh Tran
(74) *Attorney, Agent, or Firm*—Mattingly, Stanger, Malur & Brundidge, PC

(57) ABSTRACT

The output current from respective output terminals of a drive circuit (driver IC) of an organic EL display panel to respective column pins or data lines is sequentially selected by sequentially scanning a plurality of switch circuits by a switch scan circuit. The resultant output currents are converted into voltage values by resistors selected by a selector. Further, the converted voltage values sequentially generated according to the scanning of the switch scan circuit are outputted externally of the IC.

15 Claims, 1 Drawing Sheet

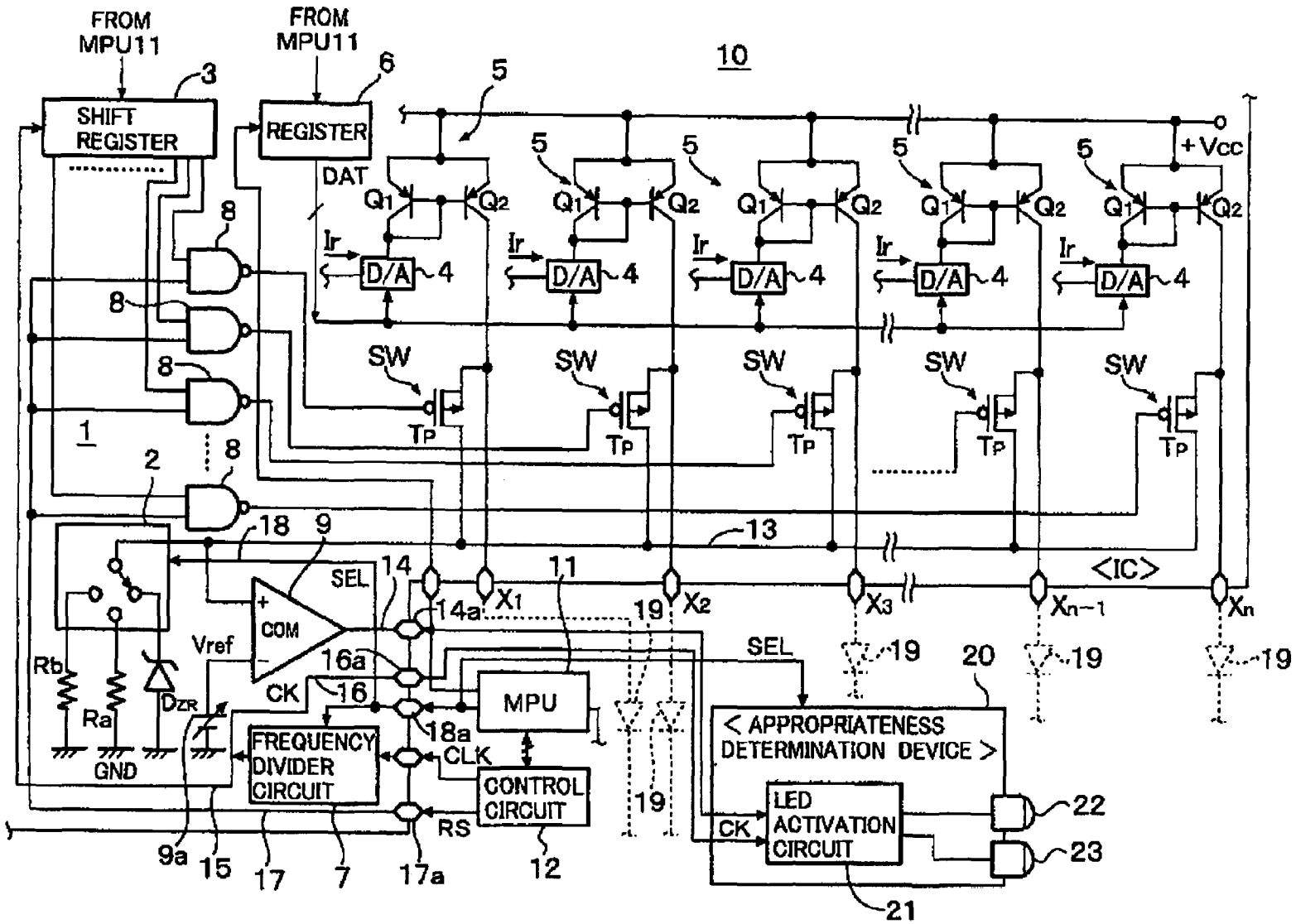
10
+Vcc
Q1
Q2
D/A
SW
Tp
Ir
5
4
<IC>
X1
X2
X3
Xn-1
Xn
19
20
< APPROPRIATENESS DETERMINATION DEVICE >
LED ACTIVATION CIRCUIT
21
22
23
SEL
CK
13
11
MPU
CONTROL CIRCUIT
12
CLK
RS
14a
18a
17a
14
16a
16
FREQUENCY DIVIDER CIRCUIT
7
17
15
9a
COM
9
Vref
DZR
Ra
Rb
GND
2
1
18
8
FROM MPU11
REGISTER
6
DAT
SHIFT REGISTER
3

ORGANIC EL PANEL DRIVING CIRCUIT, ORGANIC EL DISPLAY DEVICE AND ORGANIC EL PANEL DRIVING CIRCUIT INSPECTING DEVICE

ORGANIC EL PANEL DRIVING CIRCUIT, ORGANIC EL DISPLAY DEVICE AND ORGANIC EL PANEL DRIVING CIRCUIT INSPECTING DEVICE

The present application claims priority under 35 U.S.C. 371 of International Application No. PCT/JP2005/005123 filed on Mar. 22, 2005, which has priority based on Japan Application No. 2004-087013 filed on Mar. 24, 2004, the contents of which is hereby incorporated by reference into this application.

TECHNICAL FIELD

This invention relates to an organic EL drive circuit, an organic EL display device and a testing device of the organic EL panel drive circuit and, in particular, the present invention relates to an organic EL drive circuit of an organic EL display panel, which is capable of reducing a test time in testing an appropriateness of a current value outputted to each output terminal of a current drive circuit.

BACKGROUND ART

An organic EL display panel of an organic EL display device mounted on a portable telephone set, a PHS, a DVD player or a PDA (portable terminal device) having 396 (132×3) terminal pins of column line and 162 row line terminal pins has been proposed and the number of terminal pins of the column line and the number of terminal pins of row line tend to be further increased.

A current drive circuit of such organic EL display panel includes output stage current sources such as current mirror circuits provided correspondingly to terminal pins regardless of the type, the active matrix type or the passive matrix type.

In the passive matrix type organic EL display panel, organic EL elements (referred to as "OEL" element, hereinafter) are directly driven by the current sources. In the active matrix type organic EL display panel, pixel circuits each constructed with a capacitor, a current drive transistor and an OEL element are provided in a matrix correspondingly to display cells (pixels). The OEL element is current-driven by a drive transistor correspondingly to a voltage value stored in the capacitor, which is charged by a current corresponding to a drive current from the output stage current source.

An example of a current drive circuit of such organic EL display panel, in which a D/A converter circuit is provided for each column pin, is disclosed in JP2002-234655A (Patent Reference 1) of the applicant of this application. In this example, the D/A converters corresponding to the column pins generate drive currents in column direction corresponding to the column pins by D/A-converting display data according to a reference drive current or a current, on which the drive currents are generated, and output stage current sources of current mirror circuits are driven by the thus generated drive currents.

Patent Reference 1: JP2003-288051A

DISCLOSURE OF THE INVENTION

Problem to be Solved by the Invention

An IC (device) having the above mentioned current drive circuits is tested on whether or not output current values outputted to respective output terminals connected to respective column pins of the current drive circuits are appropriate before the IC is connected to the column pins of the organic EL display panel.

The drive circuits of the organic EL display panel drive the output stage current sources by using the D/A converters each of 4 to 6 bits to drive the OEL elements. In such case, since the precision of current conversion of the D/A converter is not good, the drive currents corresponding to the column pins tend to vary when the OEL elements are driven. Such variation of the drive currents is reflected to unevenness of luminance of display devices and luminance variation of a display device.

Therefore, it is necessary to test whether or not output currents of the respective output terminals of the drive circuits (ICs) of the organic EL drive panel are within a specified range. This test is usually performed by connecting a measuring instrument to respective output terminals and measuring output currents by an ammeter directly.

However, the settling time from a time when a probe of the measuring instrument is in contact with each of the output terminals to a time when the measuring value becomes stable due to capacitance of the probe is as long as about 10 msec. The number of output terminals increases with increase of the number of column pins and the number of measuring operations is increased. Therefore, a problem that the measuring time necessary to test one IC is increased arises.

Further, since the test of output currents is performed for each of a number of tones of display data, a total test time is largely influenced by test time for one tone.

In order to reduce the measuring time, it may be considered to develop a measuring device having probes corresponding in number to the output terminals. However, such device shall be of high cost. Since interval of the output pins (or column pins) is as narrow as 0.2 mm or less and the interval of output pins is varied, it is difficult to manufacture an appropriate measuring device as a low cost device. However, the number of column pins tends to be increased and the interval of the column pins tends to be reduced. Therefore, the number of output terminals of a drive circuit (driver IC of an organic EL display panel tends to be increased.

An object of the present invention is to provide a drive circuit of an organic EL display panel capable of shortening a test time for testing appropriateness of current values outputted from respective output terminals of the drive circuit (driver IC) of the organic EL panel and an organic EL display device using the same drive circuit.

MEANS FOR SOLVING THE PROBLEM

In order to achieve the object, a drive circuit IC of an organic EL display panel, which includes a plurality of current sources for outputting drive currents to a plurality of column lines or a plurality of data lines, comprises a plurality of switch circuits having one ends connected to the output terminals, respectively, and the other ends connected commonly, a plurality of resistors having one ends connected to a predetermined potential line, a selector for selectively connecting the other ends of the plurality of the switches to one of the other ends of the plurality of the resistors and a switch scan circuit for selectively turning the switch circuits ON sequentially with a predetermined timing, wherein the switch circuits and the switch scan circuit are provided in the IC, the output current is converted into a voltage by one of the plurality of the resistors, which is selected by the selector, for the test of the output current of the output terminal and the converted voltage value generated sequentially according to the scanning of the switch scan circuit is outputted from the IC.

A test device of the drive circuit of the organic EL display panel tests appropriateness of the drive current values of the respective output terminals of the drive circuit (driver IC) of the organic EL panel in response to the converted voltage values or signals corresponding thereto.

ADVANTAGE OF THE INVENTION

In the present invention, the output currents from the output terminals of the drive circuit (driver IC) to the respective column pins or the respective data lines are selected sequentially by sequentially scanning the switch circuits by the switch scan circuit and the voltage values converted from the output currents of the drive circuit by the resistors selected by the selector are outputted.

Therefore, it is not necessary to make a probe or probes of a measuring device in contact with the respective output terminals of the driver IC and it becomes possible to sequentially test the appropriateness of the output currents of the respective output terminals with the scanning timing by comparing the output voltage values by a comparator outside the IC. In particular, a determination of the output currents of the respective output terminals within a specification range can be made easily by switching one of the plurality of the resistors to another by the selector, so that it is possible to shorten the measuring time of the output currents of the respective output terminals.

When the comparator is provided within the IC, the result of determination related to the appropriateness of the current values of the respective output terminals can be outputted as logical values directly.

Further, when reset switches of organic EL elements (refer to "OEL elements", hereinafter) of a passive matrix type organic EL display panel as the switch circuits or reset switches such as capacitors of pixel circuits of an active matrix type organic EL display panel are used as the switch circuits, there is no need of providing the switch circuits having one ends connected to the respective output terminals. Therefore, it is possible to provide a test circuit for testing the output current values, which has a simple circuit construction, to thereby restrict an increase of the circuit size as an IC.

As a result, the appropriateness test of the current values outputted to the respective column pins (output terminals) for the respective output terminals of the drive circuit (driver IC) of the organic EL panel can be performed with a predetermined timing and the tent time can be shortened.

BRIEF DESCRIPTION OF THE DRAWINGS

The FIGURE is a block circuit diagram of a drive circuit of an organic EL display panel according to an embodiment of the present invention.

BEST MODE FOR CARRYING OUT THE INVENTION

The FIGURE is a block circuit diagram showing an organic EL display panel using an organic EL drive circuit according to an embodiment of the present invention.

In the FIGURE, a reference numeral 10 depicts a column IC driver (referred to as "column driver", hereinafter) as an organic EL drive circuit of an organic EL display panel. The column driver 10 includes D/A converters 4 and output stage current sources 5 provided correspondingly to respective output terminals X1, X2, . . . Xn. The output stage current source 5 is constructed with a current mirror circuit including transistors Q1 and Q2 and outputs a drive current to an OEL element 19 connected to one (X) of the output terminals X1, X2, . . . Xn.

In response to a reference drive current Ir and a display data DAT, each of the D/A converters 4 converts the display data DAT into an analog signal according to the reference drive current to generate drive currents corresponding the column pins, with which the output stage current sources 5 are driven. Incidentally, the display data DAT is set in a register 6 by an MPU 11 and delivered to the respective D/A converters 4.

A reset switch SW is provided for each of the output terminals. The reset switch SW is constructed with a P channel MOS transistor Tp. Sources of the transistors Tp are connected to the output terminals, respectively, and drains thereof are commonly connected to a connection line 13 through which the drains are connected to an input of a selector 2 and an input of a comparator 9.

A reference numeral 1 depicts a test circuit constructed with the selector 2, a shift register 3, a frequency divider circuit 7, a NAND gate 8 and the comparator 9.

The selector 2 selects one terminal of one of a resistor Ra, a resistor Rb and a Zener diode DZR the other terminals of which are grounded.

Representing resistances of the resistors Ra and Rb by Ra and Rb, Ra>Rb and the resistance values Ra and Rb are selected such that either one of the resistors generates an upper limit voltage and a lower limit voltage in a range in which the current, which is outputted to a corresponding output terminal X, is within an appropriate range when the current flow through the selected resistor. In this embodiment, the resistor, Ra generates the upper limit voltage and the resistor Rb generates the lower limit voltage.

The shift register 3 receives a divided clock signal CK (clock CK) from the frequency divider circuit 7 and is a switch scan circuit for sequentially selecting the reset switches SW by shifting an inputted 1-bit data ("1") according to the clock signal CK and sequentially turning the selected switches ON to sequentially select the output terminals X.

The frequency divider circuit 7 divides frequency of the clock signal CLK from the control circuit 12 to generate the clock CK and supplies the clock CK to the shift register 3 through a connection line 15. Further, the frequency divider circuit 7 supplies the clock CK externally through a connection line 16 and an output terminal 16*a*. The clock CK is lower in frequency than the clock CLK and the number of the clocks CK generated by the control circuit 12 corresponds to the number of scans of the output terminals X (reset switches SW).

The NAND gates 8 are provided correspondingly to the stages of the shift register 3 and the outputs of the respective output stages of the shift register 3 are supplied to one inputs of the NAND gates 8. Further, a reset control pulse RS is supplied from the control circuit 12 to the other inputs of the NAND gates 8 corresponding to the transistors Tp through the input terminal 17*a* and a connection line 17.

Incidentally, in the driving of the passive matrix type organic EL panel, the reset control pulse RS becomes a signal for sectioning the display period corresponding to the scan period for 1 horizontal line from the reset period (scan switching period) corresponding to the retrace period and, in the driving on the column side, the rest control pulse is the same as a timing control signal sectioning the scan period for 1 horizontal line from the retrace period.

The comparator 9 includes a variable voltage generator circuit 9*a* and has a (−) input to which the reference voltage Vref is inputted and a (+) input, which is connected to the common connection line 13. The variable voltage generator circuit 9*a* is a programmable voltage generator circuit, which generates the reference voltage according to data from the MPU 11. The reference voltage Vref is set to a voltage between the upper limit voltage and the lower limit voltage. In this voltage range, the current value is appropriate. The voltage set in this voltage range is a half of a sum of the upper and lower limit voltages. The comparator 9 generates a high level signal "H" when the input voltage is the reference voltage Vref or higher and a low level signal "L" when the input voltage is lower than the reference voltage Vref. Incidentally, the variable voltage generator circuit 9*a* generates the voltage Vref upon the setting data from the MPU 11.

When there is no selection signal SEL from the MPU 11, that is, when the selection signal SEL is "00", the Zener diode DZR is selected by the selector 2 as shown. The NAND gates 8 have the one inputs to which the reset control pulse RS from the control circuit 12 is inputted through the input terminal 17*a* and a connection line 17 and the other inputs to which the outputs of the respective stages of the shift register 3 are inputted. The outputs of the NAND gates 8 are supplied to the respective transistors Tp. When the reset control pulse RS is a high level signal "H" ("H" is significant) and the outputs of the respective output stages of the shift register 3 are "H", "L" signals appear at the output terminal of the NAND gates 8. The signals "L" are supplied to the gates of the transistors Tp, so that the transistors Tp are turned ON. Otherwise, the transistors Tp are in OFF states.

In an initial state when the power source is connected, the stages of the shift transistor 3 are set to "1" by all bits "1" outputted from the MPU 11 according to the clock CK from the frequency divider circuit 7. Therefore, the outputs of the stages of the shift register 3 become "H" and signal "L" from the NAND gates 8 are supplied to the gates of the transistors Tp in the rest period in which the reset control pulse RS is "H". Therefore, the voltages of the output terminals X become the voltage of the Zener diode DZR through the transistors Tp, which are is ON state during the reset period, the connection line 13 and the selector 2. Thus, the OEL elements 19 are reset (pre-charged). Incidentally, in this case, the cathode side of the OEL element 19 is grounded with a predetermined timing by a row side scanning.

When the MPU 11 is set to a test mode, the selector 2 receives the selection signal SEL from the MPU 11 through the input terminal 18*a* and a connection line 18. In response to the selection signal SEL, one of the resistors Ra and Rb is selected. Incidentally, the selection signal SEL is, for example, a 2-bit signal "10" and "01" and the selector 2 selects the resistors Ra and Rb in the order. The selection signal "00" means that there is no selection signal SEL. In such case, the selector 2 selects the Zener diode DZR, as mentioned previously.

When the test of appropriateness of the currents outputted to the output terminals X is performed by an appropriateness determination device 20, the MPU 11 is set to the test mode in response to a predetermined interrupt signal externally supplied to an interrupt terminal.

With this timing, the MPU 11 sets "1" in the initial stage of the shift register 3 and, in response to the external interrupt signal, the selection signal SEL for selecting one of the resistors Ra and Rb is supplied to the selector 2. The selection signal SEL is also supplied to the frequency divider circuit 7 to make it in enable state. In such case, the frequency divider 7 receives a signal "1" obtained by logical sum of the 2 bits of the selection signal SEL as an enable signal.

As a result, when the MPU 11 enters into the test mode in response to the predetermined interrupt signal, the column driver 10 becomes the operating state, the predetermined display data is set in the D/A converters 4 of the column driver and the drive currents are outputted from the output stage current sources 5 to the respective output terminals X. Further, in this case, one of the resistors Ra and Rb is selected according to the value of the selection signal SEL and the voltage obtained by converting the output current value correspondingly to the resistance value of the selected resistor is inputted to the (+) input of the comparator 9.

The comparator 9 sends the comparison result of the voltage values corresponding to the output currents of the output terminals X selected sequentially by the clock CK from the output terminal 14*a* to the appropriateness determination device 20. In this case, the clock CK is also sent from the output terminal 16*a* to the appropriateness determination device 20.

The appropriateness determination device 20 is constructed with an LED activation circuit 21, a red LED and a green LED 23. The LED activation circuit 21 is constructed with a NAND gate and an OR gate, which respond to outputs of respective digits of a shift register, and, in response to the selection signal SEL from the MPU 11 and the clock CK from the clock CK from the output terminal 16*a*, stores the result of determination of "H" and "L" of the comparator 21 by shifting the output of the comparator 9 in synchronism with the clock CK. The LED activation circuit 21 reads the stored result of determination and lights the red LED 22 through the OR gate and the green LED 23 through the NAN gate. That is, when the value of the selection signal SEL is "10", the selector 2 selects the resistor Ra having the upper limit value and the clock CK is inputted, the appropriateness determination device 20 lights the red LED 22 since the OR gate becomes "H" due to the presence of "1" in the selection signal SEL. When all are "L" while the clock CK is being received, the NAND gate becomes "H" and the appropriateness determination 20 lights the green LED 23. Contrarily to this, when the value of the selection signal SEL is "01" and the selector 2 selects the resistor Rb having the lower limit value, the appropriateness determination device 20 performs a reversely lighting operation by outputting the respective gate outputs. That is, when all are "H", the appropriateness determination device 20 lights the green LED 23 through the NAND gate and the inverter and, when at least one "L" exists, the appropriateness determination device 20 lights the red LED 22 through the OR gate and the inverter.

When the MPU 11 is in the test mode, the MPU 11 generates the value "10" of the selection signal SEL in response to the interrupt signal by an operator to cause the selector 2 to select the resistor Ra to thereby operate the frequency divider circuit 7 and the shift register 3, and cause the control circuit 12 to thereby scan the reset switches SW correspondingly to the clock CK. In this case, when the red LED 22 is not lit and the green LED 23 is lit, the MPU 11 generates the value "01" of the selection signal SEL in response to a next interrupt signal by the operator to cause the selector 2 to select the resistor Rb to thereby operate the frequency divider circuit 7 and the shift register 3, and cause the control circuit 12 to thereby scan the reset switches SW. In this case, when the red LED 22 is not lit and the green LED 23 is lit, the output currents to the respective output terminals X conform to the design specification and the column driver is accepted as (G). On the other hand, when the red LED 22 is lit by scanning the reset switches SW, the column driver is not accepted as (NG). If the red LED is lit when the reset switches SW (respective output terminal X) is scanned, the column driver 10 is not accepted.

Incidentally, in this test, the display data to be set in the D/A converters 4 may be one corresponding to maximum luminance or corresponding to intermediary luminance, etc. The values of the resistors Ra and Rb may be selected according to the display data selected.

Incidentally, the comparator 9 is constructed with an operational amplifier and has low input impedance. When the impedance of the comparator is high, it is recommendable that the test is performed after the input capacitance of the comparator 9 is charged by the output current. This can be realized by performing the test twice continuously with the first test being a dummy test. Incidentally, the comparator 9 may be provided not in the IC but on the side of the appropriateness determination device 20. In the latter case, the comparator 9 within the IC may be replaced by an A/D converter circuit. It is possible to externally output the voltage value corresponding to the output current of the output terminal as a digital value by the A/D converter circuit. In such case, it is preferable to provide a digital comparator or the like on the side of the appropriateness determination device 20.

In such case where the converted voltage is outputted as the digital value, it is enough that, when the display data set in the D/A converter 4 is changed, the determined value of the digital comparator on the appropriateness determination device 20 is changed correspondingly to the change of the display data. Thus, it is possible to fix the resistance values of the resistors Ra and Rb.

Further, the appropriateness determination device 20 may be constructed with a memory and an MPU instead of the LED activation circuit 21, the red LED 22 and the green LED 23. In the latter case, it may be possible to temporarily storing the output value of the comparator 9 or an output digital value of the A/D converter circuit and to determine the appropriateness of the device (driver IC) by performing the comparison determination by data processing. In such case, it is not necessary to divide the clock CLK by the frequency divider circuit 7 since a high speed data processing is possible.

INDUSTRIAL APPLICABILITY

In the described embodiment, although the reset switches SW are used as switches for switching the output currents, it may be possible to additionally provide switch circuits for the respective output terminals for testing the output current values.

Further, in the described embodiment, the reset switches SW for resetting the terminal voltages of the passive matrix type OEL elements 19 are scanned to sequentially select the output currents outputted to the respective output terminals X. However, instead of the OEL elements 19, capacitors for storing the current values of the respective pixel circuits of the active matrix type may be selected. In such case, the reset switches SW reset the terminal voltages of the capacitors of the pixel circuits.

Incidentally, the reset voltage of the capacitor of the pixel circuit in the active matrix type organic EL display panel may be the power source voltage +Vcc and the reset voltage in the passive matrix type organic EL display panel may be ground potential.

In the described embodiment, the drive circuit is not described for each of R, G and B. However, it may be possible to employ a circuit construction in which the output terminals X for outputting currents to the respective column lines or data lines for R, G and B are sequentially selected by the shift register 3 through the switch circuits. When the rest control pulse RS is generated for each of R, G and B, three of the shift registers are necessary. These shift registers may be connected to form a single shift register and scanned.

DESCRIPTION OF REFERENCE NUMERAL AND SIGNS

1 . . . test
2 . . . selector
3 . . . shift register
4 . . . D/A converter circuit (D/A)
5 . . . output stage current source
6 . . . register
7 . . . frequency divider circuit
8 . . . NAND gate
9 . . . comparator
10 . . . column IC driver (column driver)
11 . . . MPU
12 . . . control circuit
13 to 18 . . . connection line
19 . . . organic EL element (OEL element)
20 . . . appropriateness determination device
21 . . . LED activation circuit
22 . . . red LED
23 . . . green LED

The invention claimed is:

1. A drive circuit IC of an organic EL display panel, which includes a plurality of current sources for outputting drive currents to a plurality of column lines or a plurality of data lines, comprising:

a plurality of switch circuits;

a plurality of resistors;

a selector; and a switch scan circuit, wherein each of said plurality of switch circuits having one ends connected to one of output terminals, respectively, and the other ends of said plurality of switch circuits connected commonly, each of said plurality of resistors having one ends, and all said ends of said plurality of resistors connected to a predetermined potential line, said selector for selectively connecting the other ends of the plurality of the switches circuits to one of the other ends of the plurality of the resistors, and said switch scan circuit for selectively turning the plurality of switch circuits ON sequentially with a predetermined timing, and wherein the switch circuits and the switch scan circuit are provided in the IC, the output current is converted into a voltage by one of the plurality of the resistors, which is selected by the selector, for the test of the output current of the output terminal and the converted voltage value generated sequentially according to the scanning of the switch scan circuit is outputted from the IC.

2. The drive circuit IC of an organic EL display panel, as claimed in claim 1, wherein the switch scan circuit scans the plurality of the switch circuits according to a clock signal supplied externally of the IC to sequentially turning the switch circuits ON.

3. The drive circuit IC of an organic EL display panel, as claimed in claim 2, further comprising a frequency divider circuit, wherein the clock signal is frequency-divided by the frequency divider circuit, the switch scan circuit scans the plurality of the switch circuits according to the frequency-divided clock signal and the converted voltage value and the frequency-divided clock signal are outputted from the IC.

4. The drive circuit IC of an organic EL display panel as claimed in claim 3, further comprising a comparator provided within the IC, for comparing the converted voltage value with a predetermined voltage, wherein the selection of the plurality of the resistors by the selector is switched from one resistor to another and a result of the comparison by the comparator and the frequency-divided clock signal are outputted from the IC.

5. The drive circuit IC of an organic EL display panel as claimed in claim 4, wherein the selector selects one of the plurality of the resistors according to a selection signal supplied externally of the IC.

6. The drive circuit IC of an organic EL display panel as claimed in claim 5, further comprising a constant voltage generator circuit provided between the selector and the voltage line of the predetermined voltage, wherein the selector selects the constant voltage generator circuit and connects the commonly connected other ends of the switch circuits usually and selects one of the resistors according to the selection signal.

7. The drive circuit IC of an organic EL display panel as claimed in claim 6, wherein the organic EL display panel is passive matrix type EL display panel and the switch circuits are reset switches for resetting terminal voltages of organic EL elements of the organic EL display panel.

8. The drive circuit IC of an organic EL display panel as claimed in claim 6, wherein the organic EL display panel is an active matrix type EL display panel and the switch circuits are reset switches for resetting terminal voltages of capacitors of pixel circuits of the organic EL display panel.

9. The test device of a drive circuit of an organic EL display panel for testing appropriateness of values of the drive currents of the respective output terminals of the drive circuit of the organic EL display panel as claimed in claim 4 according to the converted voltage value or a signal corresponding thereto outputted from the IC.

10. The test device of a drive circuit of an organic EL display panel as claimed in claim 9 wherein the comparator of the drive circuit of the organic EL display panel is provided externally of the IC.

11. The drive circuit IC of an organic EL display panel as claimed in claim 2, further comprising an A/D converter circuit for converting the converted voltage value stored in the IC into a digital value, wherein the selection of the plurality of the resistors by the selector is switched from one resistor to another and the digital value and the clock signal are outputted from the IC.

12. The drive circuit IC of an organic EL display panel as claimed in claim 2, wherein, in order to determine appropriateness of the current values outputted to the output terminals, resistance values of the plurality of the resistors have predetermined values, respectively, and the switch scan circuit includes a shift register.

13. The drive circuit IC of an organic EL display panel as claimed in claim 12 wherein the predetermined resistance values of the plurality of the resistors correspond to an upper limit value and a lower limit value of a range in which the current values outputted to the respective output terminals are appropriate, respectively.

14. An organic EL display device comprising the drive circuit of the organic EL display panel as claimed in claim 1 and the organic EL display panel.

15. The test device of a drive circuit of an organic EL display panel for testing appropriateness of values of the drive currents of the respective output terminals of the drive circuit of the organic EL display panel as claimed in claim 9 according to the converted voltage value or a signal corresponding thereto outputted from the IC.

* * * * *